US005692377A

United States Patent [19]

Moriya et al.

[11] Patent Number: 5,692,377

[45] Date of Patent: Dec. 2, 1997

[54] APPARATUS FOR CONTROLLING LIFTING OPERATION

[75] Inventors: Naoyuki Moriya; Yoshinori Yamagishi; Kazunori Yoshino; Nobuaki Matoba, all of Tokyo, Japan

[73] Assignee: Shin Caterpillar Mitsubishi Ltd., Tokyo, Japan

[21] Appl. No.: 579,848

[22] Filed: Dec. 28, 1995

[30] Foreign Application Priority Data

Jan. 11, 1995 [JP] Japan ..... 7-002329

[51] Int. Cl.[6] ..... F16D 31/02

[52] U.S. Cl. ..... 60/421; 60/427; 60/429; 60/430

[58] Field of Search ..... 60/421, 428, 427, 60/429, 430

[56] References Cited

U.S. PATENT DOCUMENTS

| | | | |
|---|---|---|---|
| 3,922,855 | 12/1975 | Bridwell et al. | 60/428 X |
| 4,570,441 | 2/1986 | Yoshida et al. | 60/421 |
| 4,768,339 | 9/1988 | Aoyagi et al. | 60/428 X |
| 5,029,067 | 7/1991 | Nishida et al. | 60/421 X |
| 5,083,928 | 1/1992 | Kubomoto et al. | 60/427 X |
| 5,335,494 | 8/1994 | Benko et al. | 60/428 |

FOREIGN PATENT DOCUMENTS

| | | |
|---|---|---|
| 0 480 037 | 4/1992 | European Pat. Off. . |
| 0 593 782 | 4/1994 | European Pat. Off. . |
| 58 083737 | 5/1983 | Japan . |

*Primary Examiner*—Hoang Nguyen

*Attorney, Agent, or Firm*—Millen, White, Zelano & Branigan, P.C.

[57] ABSTRACT

An apparatus for controlling the lifting operation comprising an operation mode selection switch which is selectively set to an ordinary operation mode or to a lifting operation mode and a hydraulic circuit isolating means. The hydraulic circuit isolating means isolates the hydraulic circuit into a running drive hydraulic circuit which feeds the pressurized fluid of one of the variable-capacity hydraulic pumps to the actuators of the running apparatuses when the operation mode selection switch is set to the lifting operation mode and a hydraulic circuit for driving the apparatus on the side of the turning body, which feeds the pressurized fluid of the other variable-capacity hydraulic pump to the actuators other than those of the running apparatuses.

10 Claims, 7 Drawing Sheets

APPARATUS FOR CONTROLLING LIFTING OPERATION

FIELD OF THE INVENTION

The present invention relates to an apparatus for controlling lifting operation in a construction machine such as hydraulic shovel and the like, which is capable of carrying out operation such as chiefly running over the ground while lifting heavy materials such as Hume concrete pipes and the like in addition to carrying out ordinary operation such as excavation operation, loading operation, and the like operation.

DESCRIPTION OF THE PRIOR ART

A hydraulic shovel, in general, comprises a lower running body, an upper turning body which is provided on the lower running body to freely turn thereon, and an operation machine which is swingably mounted on the upper turning body. The lower running body is equipped with a pair of right and left running apparatuses of a type of crawler. Each running apparatus is independently driven by a running hydraulic motor which is an actuator. The upper turning body is turned by a turning hydraulic motor. The operation machine is equipped with a boom swingably mounted on the upper turning body, an arm swingably mounted on an end of the boom, and a bucket swingably mounted on an end of the arm. The boom is driven by a boom cylinder which is an actuator, provided between the upper turning member and the boom. The arm is driven by an arm cylinder which is an actuator, provided between the boom and the arm. The bucket is driven by a bucket cylinder which is an actuator, provided between the arm and the bucket. The upper turning body is equipped with a pair of variable-capacity hydraulic pumps that are driven by an engine. Each hydraulic pump is equipped with a swash plate control mechanism for controlling the blow-out rate. In this specification, "the upper turning body and the operation machine" are sometimes generally referred to as "apparatus on the side of the turning body" in order to distinguish "the running apparatus" from other apparatuses, i.e., from "the upper turning body and the operation machine".

Control valves are provided in relation to the actuators in order to control the supply of pressurized fluid to the actuators. Operation means (operation levers or operation pedals) are provided in relation to the control valves in order to control the operation of the control valves. Moreover, a running straight compensation valve is provided in order to shunt the pressurized fluid of the hydraulic pumps to the actuators. The running straight compensation valve is maintained at a first position in the case of the operation of the running apparatus only or in the case of the operation of the apparatus on the side of the turning member only, i.e., when the hydraulic shovel runs in a state where neither the turning body nor the operation machine operates or when the turning body and/or the operation machine operate in a state where the hydraulic shovel is at rest. In this case, there are formed a hydraulic circuit in which the pressurized fluid of one of the hydraulic pumps is fed to one of the running hydraulic motors, to the bucket cylinder and to the boom cylinder and a hydraulic circuit in which the pressurized fluid of the other hydraulic pump is fed to the other running hydraulic motor, to the turning hydraulic motor and to the arm cylinder. That is, the pressurized fluid of one of the hydraulic pumps is fed to the actuator of one of the running apparatuses and to some actuators of the apparatus on the side of the turning body, and the pressurized fluid of the other hydraulic pump is fed to the actuator of the other running apparatus and to the remaining actuators of the apparatus on the side of the turning body. In the hydraulic circuit of this constitution, the pressurized fluids of the hydraulic pumps are shunt to be fed to the actuators of one of the running apparatuses and to the actuators of the other running apparatus. In this specification, therefore, the hydraulic circuit of this constitution is referred to as "shunt hydraulic circuit".

The running straight compensation valve is changed over from the first position to the second position when the running apparatus and the apparatus on the side of the turning body operate together, i.e., when the turning body and/or the operation machine operate(s) while the hydraulic shovel is running. As a result, there are formed a running drive hydraulic circuit in which the pressurized fluid of one of the hydraulic pumps is all fed to the running hydraulic motors and a hydraulic circuit for driving the apparatus on the side of the turning body in which the pressurized fluid of the other hydraulic pump is all fed to the turning hydraulic motor, arm cylinder, bucket cylinder and boom cylinder. In the hydraulic circuit of this constitution, the pressurized fluid of one of the hydraulic pumps is all fed to the actuators of the running apparatuses and the pressurized fluid of the other hydraulic pump is all fed to the actuators of the apparatus on the side of the turning body, each being isolated from the other. In this specification, therefore, the hydraulic circuit of this constitution is referred to as "isolated hydraulic circuit".

When the above-mentioned conventional hydraulic shovel runs without actuating the apparatus on the side of the turning body, the above-mentioned shunt hydraulic circuit is formed. When the operation means is operated to actuate the apparatus on the side of the turning body in this running state, the running straight compensation valve is changed over from the first position to the second position as described above. Accordingly, the circuit is changed over from the shunt hydraulic circuit to the isolated hydraulic circuit. In this case, the running drive hydraulic circuit and the hydraulic circuit for driving the apparatus on the side of the turning body are communicated with each other through an orifice provided in the running straight compensation valve. Therefore, the pressurized fluid of the other hydraulic pump fed to the actuators of the apparatus on the side of the turning body is also partly fed to the side of the running hydraulic motors, thereby to reduce the shock caused by change-over of the running straight compensation valve at the time of changing the running speed. Owing to the above-mentioned action, the running straight performance is compensated even when the apparatus on the side of the turning body is actuated while the hydraulic shovel is running.

When the apparatus on the side of the turning body is actuated while the hydraulic shovel is running, however, the shunt hydraulic circuit is changed over to the isolated hydraulic circuit, and the amount of the pressurized fluid fed to the running hydraulic motors decreases from the blow-out rate of the two hydraulic pumps to nearly the blow-out rate of one hydraulic pump. Accordingly, the running speed decreases when the apparatus on the side of the turning body is actuated while the hydraulic shovel is running, and returns to the initial running speed when the operation of the apparatus on the side of the turning body is halted. Similarly, when the hydraulic shovel starts running while the apparatus on the side of the turning body is in operation, the operation speed of the apparatus on the side of the turning body decreases. The operation speed of the apparatus on the side of the turning body increases again when the hydraulic shovel stops running. Therefore, when the article is lifted up and is carried in such a manner as described above by using the above-mentioned conventional hydraulic shovel, the running speed of the hydraulic shovel undergoes a change or the operation speed of the apparatus on the side of the turning body undergoes a change, causing the load that is lifted to swing and, hence, impairing operation performance and making it difficult to execute the lifting operation.

In the above-mentioned conventional hydraulic shovel, furthermore, the operation speeds of the running apparatuses and of the apparatus on the side of the turning body are suited for carrying out ordinary operations such as excavation operation and loading operation, but are too fast for carrying out the above-mentioned lifting operation, impairing operation performance and workability.

SUMMARY OF THE INVENTION

The object of the present invention is to provide an improved apparatus for controlling the lifting operation, which features improved operation performance in the lifting operation enabling the lifting operation to be carried out more easily.

Another object of the present invention is to provide an improved apparatus for controlling the lifting operation according to which, during the lifting operation, the running apparatuses and the apparatus on the side of the turning body operate at speeds slower than those of during the ordinary operations, enabling the operation performance and workability during the lifting operation to be enhanced.

According to one aspect of the present invention, there is provided an apparatus for controlling the lifting operation in a construction machine comprising a lower running body including a pair of running apparatuses, an upper turning body provided on said lower running body to freely turn thereon, an operation machine swingably mounted on said upper turning body, actuators for actuating said running apparatuses, said upper turning body and said operation machine, and a pair of variable-capacity hydraulic pumps for feeding pressurized fluid to said actuators, wherein it further comprises:

an operation mode selection means which is selectively set to an ordinary operation mode or to a lifting operation mode; and a hydraulic circuit isolating means for isolating the hydraulic circuit into a running drive hydraulic circuit which feeds the pressurized fluid of one of said variable-capacity hydraulic pumps to the actuators of said running apparatuses when said operation mode selection means is set to said lifting operation mode and a hydraulic circuit for driving the apparatus on the side of the turning body, which feeds the pressurized fluid of the other variable-capacity hydraulic pump to the actuators other than those of said running apparatuses.

According to another aspect of the present invention, there is provided an apparatus for controlling the lifting operation in a construction machine comprising a lower running body including a pair of running apparatuses, an upper turning body provided on said lower running body to freely turn thereon, an operation machine swingingly mounted on said upper turning body, actuators for actuating said running apparatuses, said upper turning body and said operation machine, a pair of variable-capacity hydraulic pumps for feeding pressurized fluid to said actuators, control valves provided in relation to said running apparatuses, said upper turning body and said operation machine in order to control the supply of pressurized fluids to said actuators, and an operation means provided in relation to said control valves to control their operations, wherein it further comprises:

an operation mode selection means which is selectively set to an ordinary operation mode or to a lifting operation model; and an operation speed setting means which, when said operation mode selection means is set to said lifting operation mode, sets the operation speeds of said actuators that vary depending upon the operation quantities of said operation means to be smaller than those of when said ordinary operation mode is set.

The apparatus for controlling the lifting operation constituted according to one aspect of the present invention is equipped with an operation mode selection means which is selectively set to an ordinary operation mode or to a lifting operation mode, and a hydraulic circuit isolating means for isolating the hydraulic circuit into a running drive hydraulic circuit which feeds the pressurized fluid of one of said variable-capacity hydraulic pumps to the actuators of said running apparatuses when said operation mode selection means is set to said lifting operation mode and a hydraulic circuit for driving the apparatus on the side of the turning body, which feeds the pressurized fluid of the other variable-capacity hydraulic pump to the actuators other than those of said running apparatuses. When the operation mode is set to the lifting operation mode, therefore, an isolated hydraulic circuit is automatically formed. Accordingly, interference to load between the actuators of the running apparatuses and the actuators of the apparatus on the side of the turning body is greatly decreased compared with that of the prior art, contributing to improving operation performance in the lifting operation and facilitating the lifting operation.

In the above-mentioned apparatus for controlling the lifting operation equipped with the hydraulic circuit separating means which completely isolates the running drive hydraulic circuit from the hydraulic circuit for driving the apparatus on the side of the turning body when the operation means of either the running apparatuses or the apparatus on the side of the turning body is manipulated, the above-mentioned interference to load is completely suppressed, and the operation performance and workability are further enhanced.

In the above-mentioned apparatus for controlling the lifting operation equipped with the operation speed setting means which, when the operation mode selection means is set to the lifting operation mode, sets the operation speeds of the actuators that vary depending upon the operation quantities of the operation means to be smaller than those of when the ordinary operation mode is set, it is allowed to decrease the operation speeds of the running apparatuses and of the apparatus on the side of the turning body to be smaller than those of during the ordinary operation when the operation mode is set to the lifting operation mode. This makes it possible to greatly enhance the operation performance in the lifting operation and to very facilitate the lifting operation. With a decrease in the operation speeds of the actuators of the running apparatuses and of the apparatus on the side of the turning body, furthermore, interference to load is completely suppressed between the actuators of the running apparatuses and the actuators of the apparatus on the side of the turning body. Besides, the load is interfered little among the actuators of the apparatus on the side of the turning body, and operation performance and workability in the lifting operation are further improved.

The apparatus for controlling the lifting operation constituted according to another aspect of the present invention is equipped with an operation mode selection means which is selectively set to an ordinary operation mode or to a lifting operation mode, and an operation speed setting means which, when said operation mode selection means is set to said lifting operation mode, sets the operation speeds of said actuators that vary depending upon the operation quantities of said operation means to be smaller than those of when said ordinary operation mode is set. When the operation mode is set to the lifting operation mode, therefore, the operation speeds of the running apparatuses and of the apparatus on the side of the turning body become slower than those of under the ordinary operation. This makes it possible to enhance the operation performance in the lifting operation and to facilitate the lifting operation. With a decrease in the operation speeds of the actuators of the running apparatuses and of the apparatus on the side of the turning body, furthermore, the load is interfered little among the actuators, and operation performance in the lifting operation is improved.

DETAILED DESCRIPTION OF THE PREFERRED EMBODIMENTS

Figure 1:
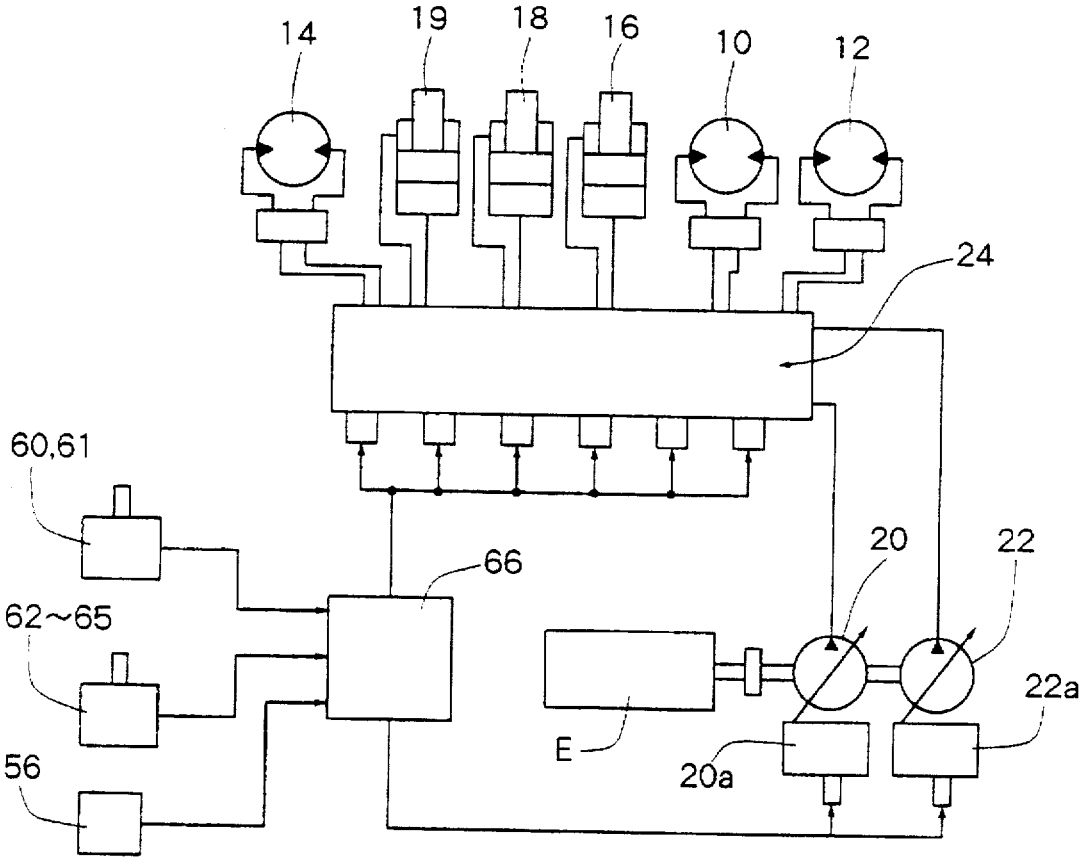
FIG. 1 is a diagram which schematically illustrates an apparatus for controlling the lifting operation improved according to an embodiment of the present invention.
Figure 2:
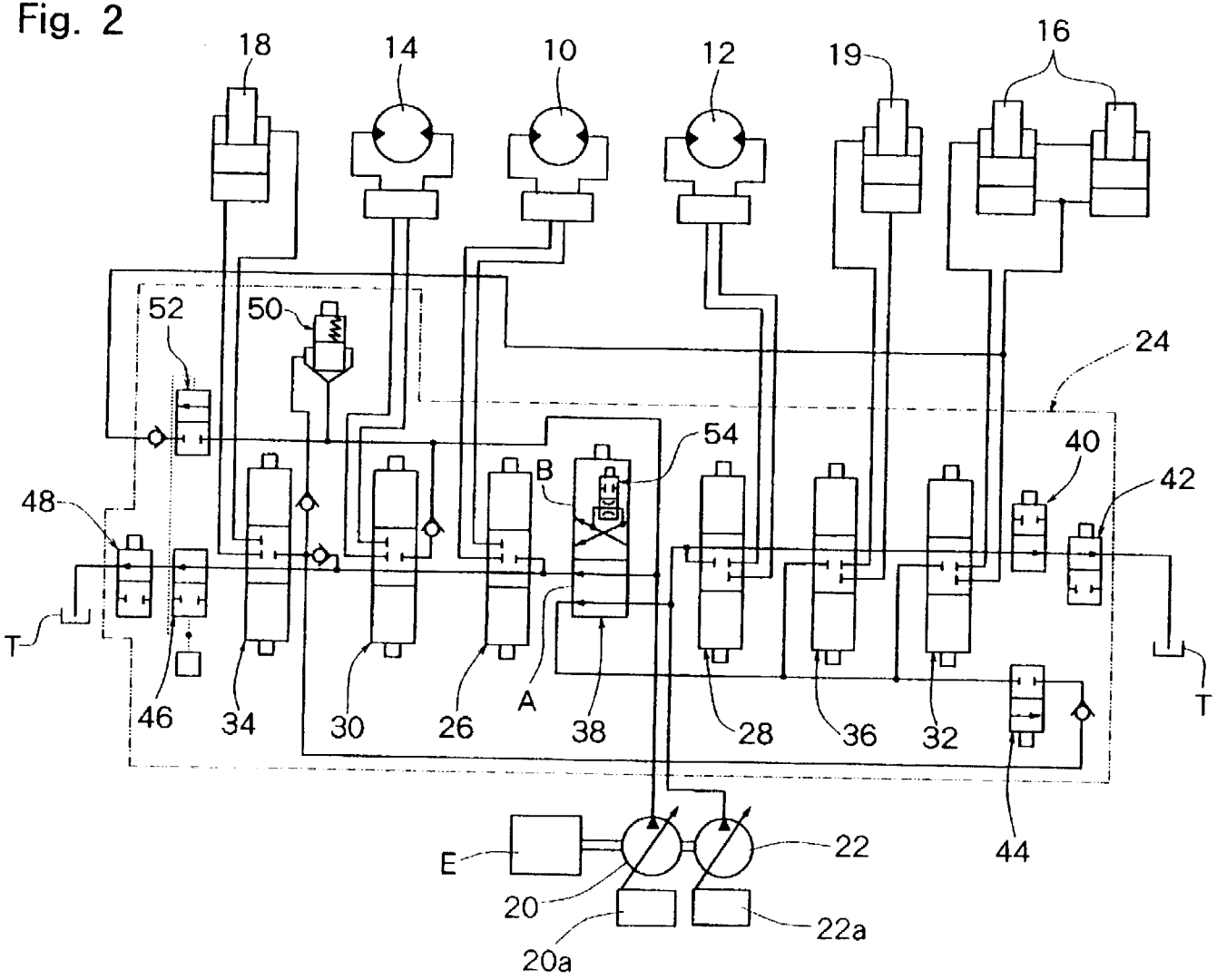
FIG. 2 is a diagram illustrating in detail a hydraulic circuit included in the apparatus for controlling the lifting operation of FIG. 1.
Figure 10:
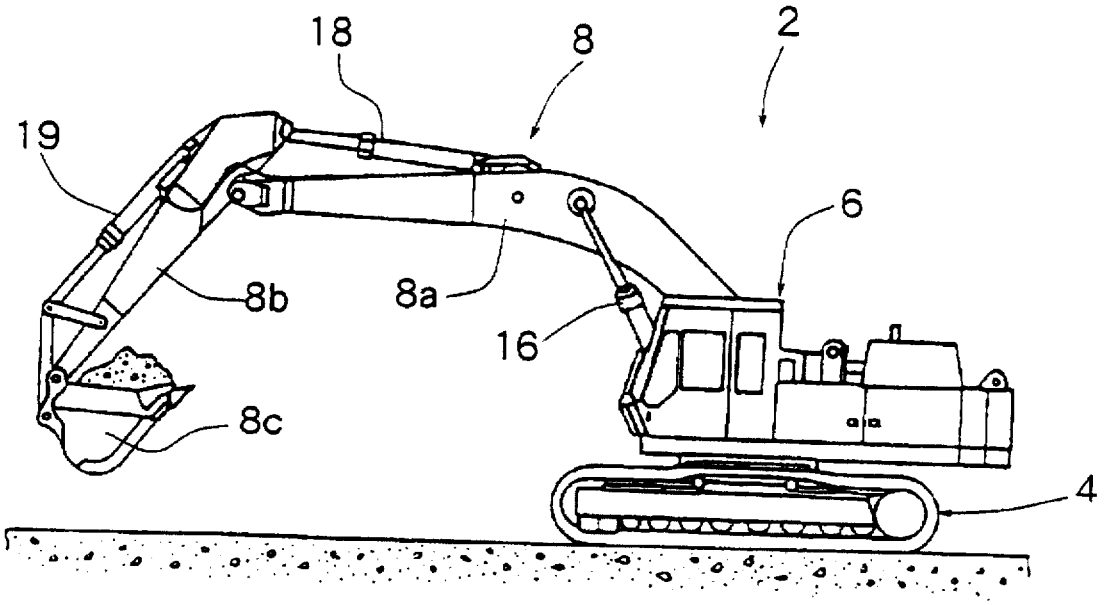
FIG. 10 is a side view of a hydraulic shovel equipped with the apparatus for controlling the lifting operation of FIG. 1.

An apparatus for controlling the lifting operation in a construction machine improved according to an embodiment of the present invention will now be described in detail with reference to the accompanying drawings. Referring to FIGS. 1, 2 and 10, and, chiefly, to FIG. 10, reference numeral 2 denotes a hydraulic shovel which is equipped with the apparatus for controlling the lifting operation improved according to an embodiment of the present invention. The hydraulic shovel 2 is equipped with a lower running body 4, an upper turning body 6 mounted on the lower running body 4 to freely turn thereon, and an operation machine 8 swingably mounted on the upper turning body 6. The lower running body 4 is equipped with a pair of right and left running apparatuses of the type of crawler. The right and left running apparatuses are independently driven by running hydraulic motors 10 and 12 (see FIG. 2) which are actuators. The upper turning body 6 is turned by a turning hydraulic motor 14 (see FIG. 2). The operation machine 8 is equipped with a boom 8*a* swingably mounted on the upper turning body, an arm 8*b* swingably mounted on an end of the boom 8*a*, and a bucket 8*c* swingably mounted on an end of the arm 8*b*. The boom 8*a* is driven by a pair of boom cylinders 16 which are actuators provided between the upper turning body 6 and the boom 8*a*. The arm 8*b* is driven by an arm cylinder 18 which is an actuator provided between the boom 8*a* and the arm 8*b*. The bucket 8*c* is driven by a bucket cylinder 19 which is an actuator provided between the arm 8*b* and the bucket 8*c*. The upper turning body 6 is provided with a pair of variable-capacity hydraulic pumps 20 and 22 driven by an engine E. The hydraulic pumps 20 and 22 are constituted by swash plate-type axial piston pumps equipped with swash plate controllers 20*a* and 22*a* for controlling the blow-out rates.

Next, referring chiefly to FIGS. 1 and 2, a control valve 24 is provided between the hydraulic pumps 20, 22 and the actuators. The control valve 24 includes a running control valve 26 for controlling the pressurized fluid that is fed to the running hydraulic motor 10, a running control valve 28 for controlling the pressurized fluid fed to the running hydraulic motor 12, a turn control valve 30 for controlling the pressurized fluid fed to the turning hydraulic motor 14, a boom control valve 32 for controlling the pressurized fluid fed to the boom cylinders 16, an arm control valve 34 for controlling the pressurized fluid fed to the arm cylinder 18, and a bucket control valve 36 for controlling the pressurized fluid fed to the bucket cylinder 19. The control valve 24 is provided with a running straight compensation valve 38. When the running straight compensation valve 38 is located at a first position (chamber A) in FIG. 2, there are formed a hydraulic circuit in which the pressurized fluid blown out from the hydraulic pump 22 is fed to the running hydraulic motor 12, bucket cylinder 19 and boom cylinder 16, and a hydraulic circuit in which the pressurized fluid blown out from the hydraulic pump 20 is fed to the running hydraulic motor 10, turning hydraulic motor 14 and arm cylinder 18.

In a state of FIG. 2 in which a shunt hydraulic circuit is formed, the pressurized fluid blown out from the hydraulic pump 22 is returned back to a tank T via a by-pass line passing through the running control valve 28, bucket control valve 36, boom control valve 32, by-pass valve 40 and change-over valve 42. The hydraulic circuit is further so constituted that the pressurized fluid blown out from the hydraulic pump 22 is fed to the bucket control valve 36 and to the boom control valve 32 via the running straight compensation valve 38 on the upstream side of the running control valve 28, and is fed to the arm cylinder 18 via a confluence valve 44 and arm control valve 34. On the other hand, the hydraulic circuit is so constituted that the pressurized fluid blown out from the hydraulic pump 20 is returned back to the tank T via a by-pass line passing through the running straight compensation valve 38, running control valve 26, turning control valve 30, arm control valve 34, by-pass valve 46 and change-over valve 48, and is also fed to the running control valve 26 and to the arm control valve 34. The hydraulic circuit is further so constituted that on the upstream side of the running straight compensation valve 38, the pressurized fluid blown out from the hydraulic pump 20 is fed to the turning control valve 30 and to the arm control valve 34 via a logic valve 50, and is also fed to the boom cylinder 16 via a confluence valve 52. The by-pass valves 40, 46, change-over valves 42, 48, and confluence valves 44, 52 are all included in the control valve 24. The running straight compensation valve 38 has a chamber B which is provided with two flow passages through which will flow pressurized fluid blown out from the hydraulic pumps 20 and 22, the flow passages being communicated with each other via a communication flow passage. The communication flow passage is opened and closed by a change-over valve 54 provided in the running straight compensation valve 38. An orifice is formed when the communication flow passage is opened by the change-over valve 54. The above-mentioned valves provided in the control valve 24 are all electromagnetic valves, and the running straight compensation valve 38 and the change-over valve 54 are ON-OFF valves, and other valves are all proportional control valves (in which the secondary pressure changes continuously).

Figure 4:
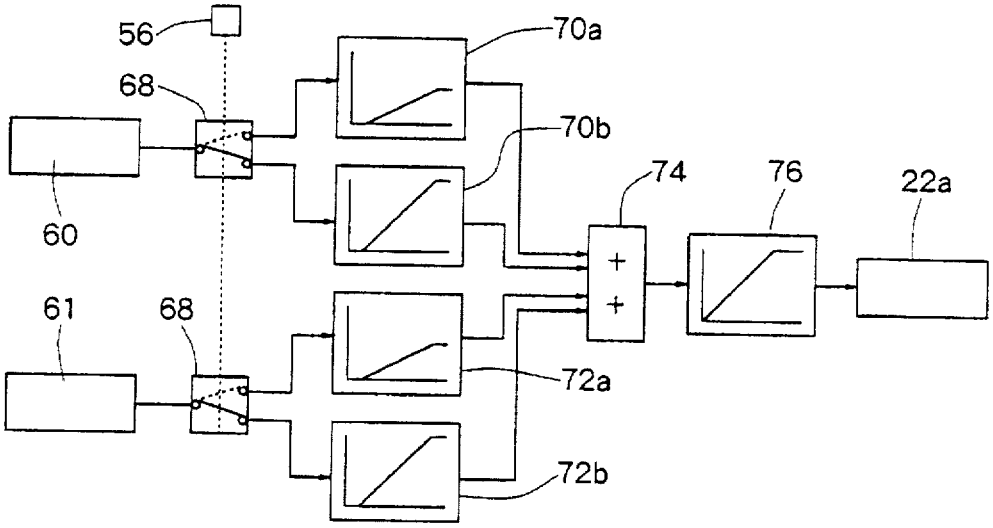
FIG. 4 is a flow chart of signals illustrating the processing of signals of one pump flow rate setting means related to the operation of a running apparatus in the apparatus for controlling the lifting operation of FIG. 1.
Figure 5:
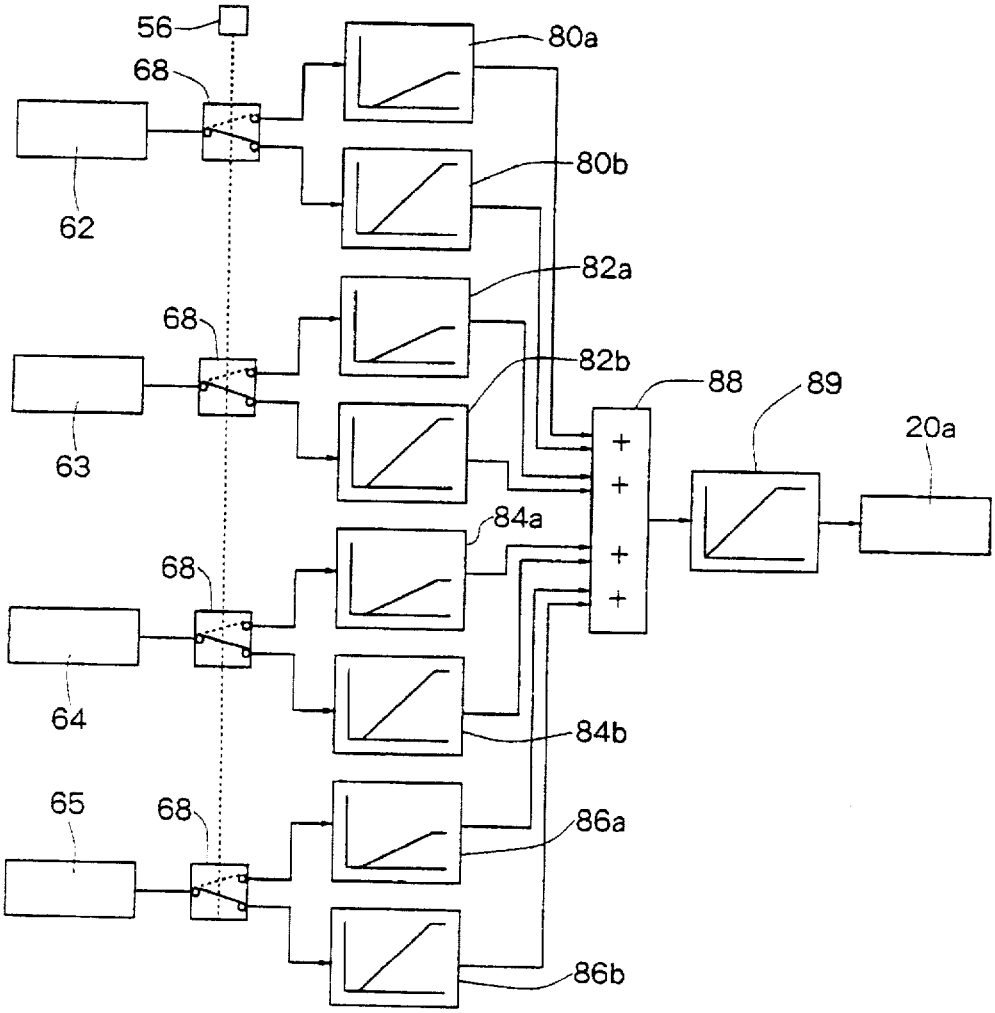
FIG. 5 is a flow chart of signals illustrating the processing of signals of the other pump flow rate setting means related to the operation of an apparatus on the side of a turning body in the apparatus for controlling the lifting operation of FIG. 1.

In the apparatus for controlling the lifting operation improved according to the present invention, as shown further in FIGS. 4 and 5, provision is made of an operation mode selection switch 56 constituting the operation mode selection means, manual operation means 60 to 65 for operating the actuators, and a control unit 66. The operation mode selection switch 56 is a manual switch which is capable of selecting either the ordinary operation mode or the lifting operation mode. The operation means 60 to 65 are a running operation means 60 for actuating the running hydraulic motor 10 via the running control valve 26, a running operation means 61 for actuating the running hydraulic motor 12 via the running control valve 28, a boom operation means 62 for actuating the boom cylinders 16 via the boom control valve 32, an arm operation unit 63 for actuating the arm cylinder 18 via the arm control valve 34, a bucket operation means 64 for actuating the bucket cylinder 19 via the bucket control valve 36, and a turn operation means 65 for actuating the turning hydraulic motor 14 via the turning control valve 30. That is, the operation means 60 and 61 are those (operation pedals in this embodiment) for actuating the running apparatuses, and the operation means 62 to 65 are those (operation levers in this embodiment) for actuating the apparatus on the side of the turning body. The operation means 60 to 65 are provided with potentiometers that are not shown, to output electric signals that vary depending upon the operation quantities of the operation means. The signals output from the operation mode selection switch 56 and the operation means 60 to 65 are input to the control unit 66. The control unit 66 is constituted by a microcomputer and includes a central processing means which executes arithmetic processing in compliance with a control program, a ROM for storing a control program, an operation mode selection switch 56, a storage device having RAM for storing signals from the operation means 60 to 65 and for storing the results of arithmetic processing, and an input/output interface. The output signal of the control unit 66 is fed to the swash plate controllers **20*a* and 22*a*, transformed into hydraulic pressures to set the angles of inclination of the swash plates, so that the blow-out rates of the hydraulic pumps 20 and 22 are controlled as will be described later. The output signal of the control unit 66 is further fed to electromagnetic valves included in the control valve 24**, whereby the electromagnetic valves are controlled as will be described later.

Figure 3:
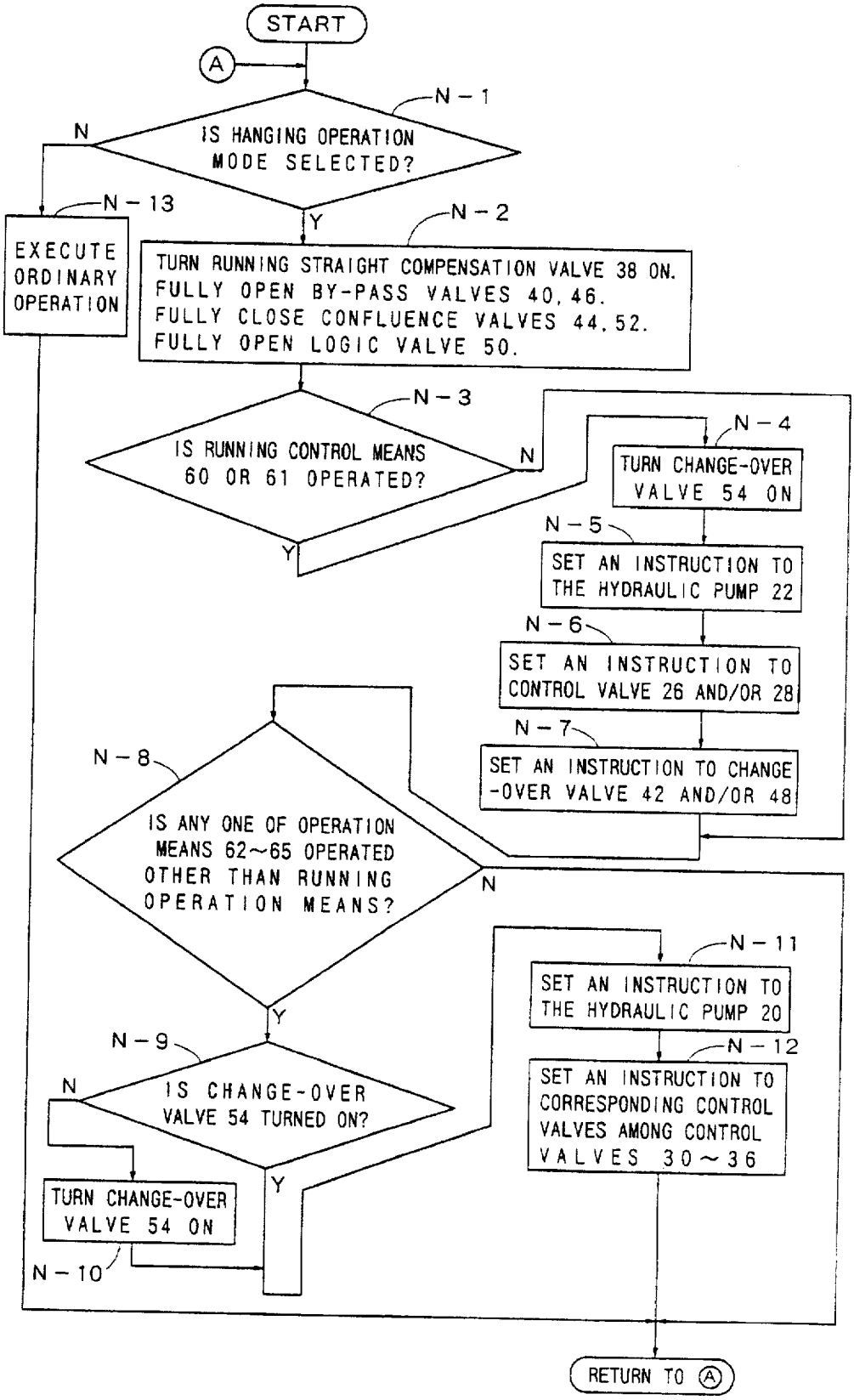
FIG. 3 is a flow chart schematically illustrating part of the procedure of operation of the apparatus for controlling the lifting operation of FIG. 1.

Described below with reference to FIGS. 1, 2 and 3 is the control operation of the control unit 66. If considered from the standpoint of signal processing, the diagramed control unit 66 includes an operation mode selection means which is selectively set to the ordinary operation mode or to the lifting operation mode, and an operation speed setting means which, when the lifting operation mode is selected, sets the operation speeds of the actuators 10 to 19 that vary depending upon the operation quantities of the operation means 60 to 65 to be slower than the operation speeds of under the ordinary operation mode. The operation speed setting means includes one of pump flow rate setting means for setting the blow-out rate of the hydraulic pump 22 depending upon the operation quantities of the operation means 60 and 61 of the running apparatuses, the other pump flow rate setting means for setting the blow-out rate of the hydraulic pump 20 depending upon the operation quantities of the operation means 62 to 65 of the apparatuses other than the running apparatuses, and a control valve opening degree setting means for setting the opening degrees of the control valves 30 to 36 depending upon the operation quantities of the running apparatuses, upper turning body 6 and operation machine 8. These means will become obvious in the following description of the operation procedure of the apparatus for controlling the lifting operation.

At a step N-1, it is judged whether the lifting operation mode is selected or not. When the operator operates the operation mode selection switch 56 which is the operation mode selection means, the signal is input to the operation mode selection means of the control unit 66 and the lifting operation mode is set. When the lifting operation mode is selected, the program proceeds to a step N-2. When the ordinary operation mode is selected, the program proceeds to a step N-13 where the ordinary operation is executed. The following processing is executed at the step N-2. That is, the running straight compensation valve 38 constituting the hydraulic circuit isolating means is turned on and is changed over from the first position A to the second position B shown in FIG. 2. The by-pass valves 40 and 46 are fully opened, the confluence valves 44 and 52 are fully closed, and the logic valve 50 is fully opened. As a result, there are formed a running drive hydraulic circuit in which the pressurized fluid of the hydraulic pump 22 is all fed to the running hydraulic motors 10 and 12, and a hydraulic circuit for driving the apparatus on the side of the turning body in which the pressurized fluid of the hydraulic pump 20 is all fed to the turning hydraulic motor 14, arm cylinder 18, bucket cylinder 19 and boom cylinder 16. The two circuits are communicated with each other (change-over valve 54 is in an OFF state as shown in FIG. 2) through the orifice which is a hydraulic circuit communication passage formed in the running straight compensation valve 38 and hence are not completely isolated from each other. With the above-mentioned isolated hydraulic circuit being formed, however, interference to the load (phenomenon in which part of the pressurized fluid flows from the side of the hydraulic pump 20 to the side of the hydraulic pump 22 or in the opposite direction due to the operations of the actuators) becomes smaller than that of the prior art between the actuators (running hydraulic motors 10 and 12) of the running apparatuses and the actuators (turning hydraulic motor 14, arm cylinder 18, bucket cylinder 19 and boom cylinder 16) of the apparatus on the side of the turning body in the range of an operation mode which is the lifting operation, contributing to enhancing operation performance and workability in the lifting operation (in the prior arts the isolated hydraulic circuit and the shunt hydraulic circuit are changed over to each other even in the range of one operation mode which is the lifting operation).

At a step N-3, it is judged whether the running operation means 60 or 61 is operated or not. The program proceeds to a step N-4 when the running operation means 60 or 61 is operated, and proceeds to a step N-8 when the running operation means 60 or 61 is not operated. At the step N-4, the change-over valve 54 constituting the hydraulic circuit separating means is turned on and is changed from the position shown in FIG. 2 to the other position. As a result, the hydraulic circuit communication passage formed in the running straight compensation valve 38 is shut off, and the running drive hydraulic circuit is completely isolated from the hydraulic circuit for driving the apparatus on the side of the turning body. Interference to the load is completely suppressed between the actuators of the running apparatuses and the actuators of the apparatus on the side of the turning body, contributing to further enhance the operation performance and workability in the lifting operation. When not only the running operation means 60 or 61 is operated but also any one of the operation means 60 to 65 inclusive of other operation means 62 to 65 is operated, the change-over valve 54 is turned on, and the above-mentioned completely isolated hydraulic circuit is formed as will be easily comprehended from the description appearing later.

At a step N-5, an instruction is set to the hydraulic pump 22 depending upon the operation quantities (operation signals) of the running operation means 60 and 61 in order to actuate the running hydraulic motors 10 and 12. The running operation means 60 and 61 are operated separately or simultaneously. Referring to FIG. 4, the output signal of the running operation means 60 is fed to a flow-rate setter **70*a* or 70*b* via a change-over switch 68. Moreover, the output signal of the running operation means 61 is fed to a flow-rate setter 72*a* or 72*b* via a change-over switch 68. The change-over switches 68 are changed over by a operation mode selection switch 56 that is manually operated. When the lifting operation mode is selected by the operation mode selection switch 56, the change-over switches 68 are changed over to the side of dotted lines in FIG. 4. As a result, the output signal of the running operation means 60 is fed to the flow-rate setter 70*a* via the change-over switch 68, and the output signal of the running operation means 61 is fed to the flow rate setter 72*a* via the change-over switch 68**.

The flow-rate setter **70*a* sets an instruction to the hydraulic pump 22 in accordance with an output signal which varies depending upon the operation quantity of the running operation means 60. That is, in response to an output signal that varies depending upon the operation quantity of the running operation means 60, the flow-rate setter 70*a* sets an instruction that corresponds to a blow-out rate which the running hydraulic motor 10 requires from the hydraulic pump 22. The flow-rate setter 72*a* sets an instruction to the hydraulic pump 22 of the running hydraulic motor 12 in accordance with an output signal which varies depending upon the operation quantity of the running operation means 61. That is, in response to an output signal that varies depending upon the operation quantity of the running operation means 61, the flow-rate setter 72*a* sets an instruction that corresponds to a required blow-out rate which the running hydraulic motor 12 requires from the hydraulic pump 22. Outputs from the flow-rate setters 70*a* and 72*a* are summed up through an adder 74, subjected to the upper-limit and lower-limit processings through an upper-and-lower limit setter 76 to set an instruction to the pump. The output of the upper-and-lower limit setter 76 is fed to the swash plate controller 22*a* of the hydraulic pump 22. The swash plate controller 22*a* converts the output signal of the upper-and-lower limit setter 76 into a voltage through a D/A converter and further converts it into an electric current through a proportional valve amplifier. The electric current is converted into a pressure through an electromagnetic proportional valve, and the angle of inclination of the swash plate is set in accordance with the pressure in order to set the blow-out rate of the hydraulic pump 22**.

Figure 8:
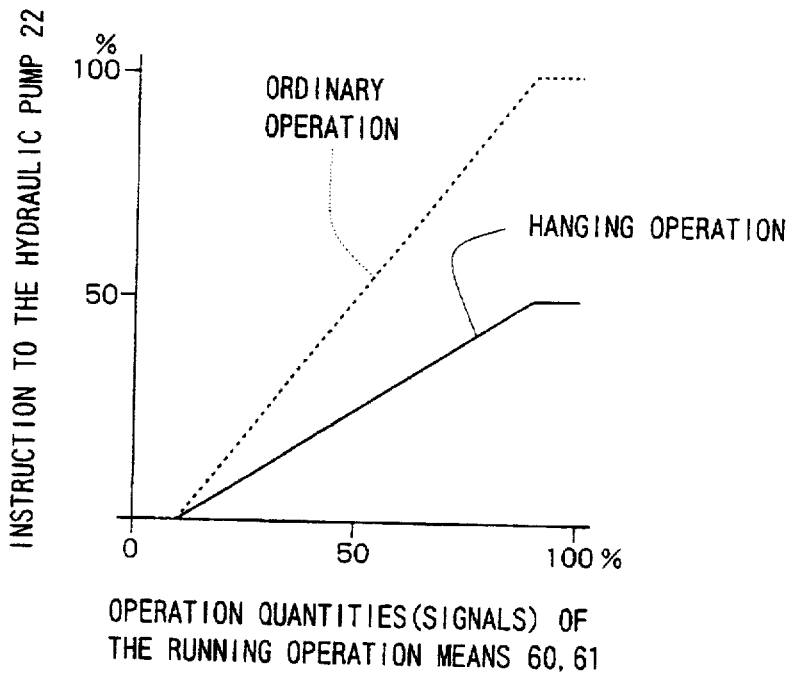
FIG. 8 is a diagram illustrating one example of a relationship between the operation quantities of the running apparatus and the instruction set to the hydraulic pump in the apparatus for controlling the lifting operation of FIG. 1 by comparing the lifting operation with the ordinary operation.

In this case, a perfectly independent hydraulic circuit is formed by the change-over valve 54 that has been turned on and, hence, the pressurized fluid is fed to the running hydraulic motors 10 and 12 from the hydraulic pump 22 only. Therefore, the flow-rate setters **70*a* and 72*a* so set an instruction to the hydraulic pump 22 that the blow-out rate of the hydraulic pump 22 that varies depending upon the operation quantities of the running operation means 60 and 61 in the lifting operation modes is about one-half the blow-out rate of during the ordinary operation modes as shown by a solid line in FIG. 8. Therefore, the running speed of the hydraulic shovel 2** during the lifting operation is slower than that of during the ordinary operation, which is effective in suppressing the lifted load from swinging.

Figure 9:
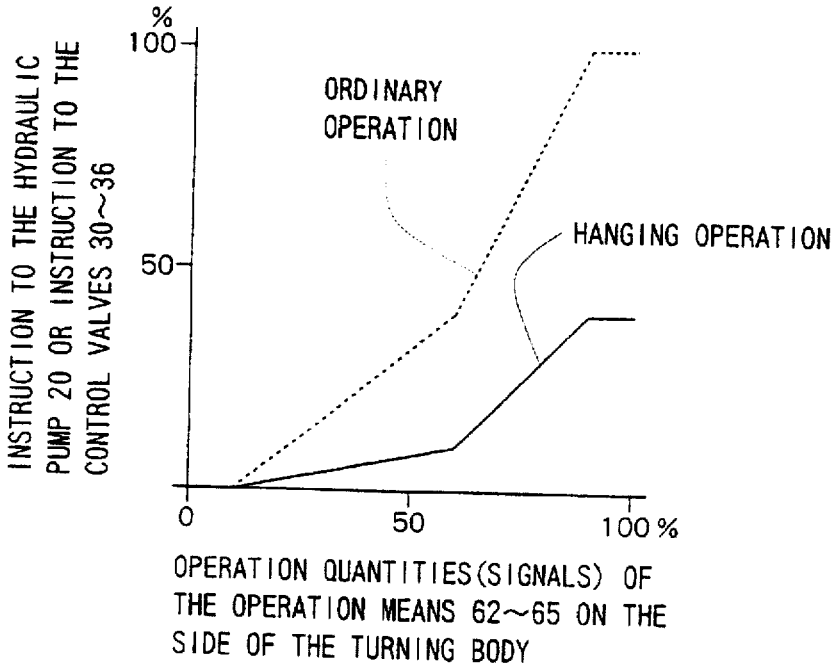
FIG. 9 is a diagram illustrating one example of a relationship between the operation quantity of the apparatus on the side of the turning body and the instruction set to the hydraulic pump or the instruction set to the control valves in the apparatus for controlling the lifting operation of FIG. 1 by comparing the lifting operation with the ordinary operation.

At a step N-6, an instruction is set to the control valve 26 and/or 28 depending upon the operation quantity of the running operation means 60 and/or 61 in order to control the supply of the pressurized fluid to the running hydraulic motor 10 and/or 12. The output signal of the running operation means 60 is fed to a control valve opening degree setter that is not shown. The control valve opening degree setter sets an instruction to the corresponding running control valve 26 in response to an output signal that varies depending upon the operation quantity of the running operation means 60. That is, in response to an output signal that varies depending upon the control quantity of the running operation means 60, the opening degree of the running control valve 26 is calculated to obtain a flow rate that is to be fed to the running hydraulic motor 10, and an instruction value is set. The output signal of the control valve opening degree setter is converted into a voltage through the D/A converter, converted into an electric current value through a proportional valve amplifier, and is fed to one solenoid (e.g., upper solenoid in FIG. 2) of the running control valve 26 which is made up of an electromagnetic proportional valve, in the operation direction of the running operation means 60. The output signal of the running operation means 61 is also fed to a similar control valve opening degree setter, subjected to the similar processing, and is fed as an electric current value to one solenoid of the running control valve 28 made up of an electromagnetic proportional valves in the operation direction of the running operation unit 61. During the lifting operation, the control valve opening degree setters set the opening degrees based upon operation signals of the running operation means 60 and 61 in the same manner as during the ordinary operation (control operation is carried out in accordance with the characteristics represented by a dotted line in FIG. 9).

Figure 7:
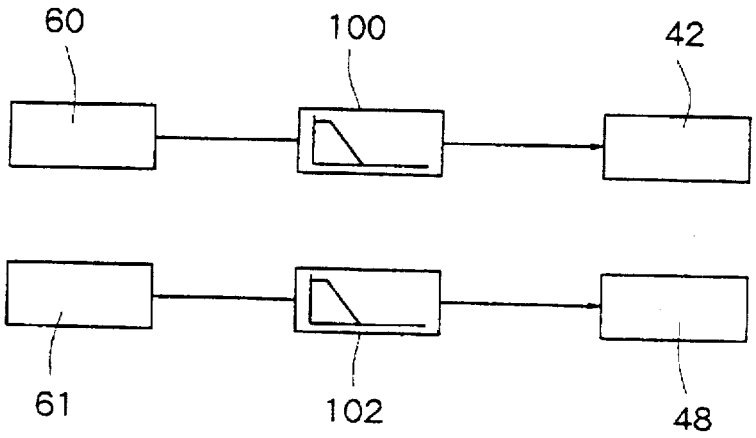
FIG. 7 is a flow chart of signals illustrating the processing of signals of a change-over valve opening degree setting means related to the operation of the running apparatus in the apparatus for controlling the lifting operation of FIG. 1.

At a step N-7, an instruction is set to the change-over valve 42 and/or 48 depending upon the operation quantities of the running operation means 60 and/or 61. With reference to FIG. 7 together with FIG. 2, when the running operation means 60 is operated, the control valve 26 is operated according to the step N-6 mentioned above, and an instruction is set, depending upon the operation quantity of the running operation means 60, to the change-over valve 42 disposed on a by-pass line of the side (right side in FIG. 2) opposite to the by-pass line on which the control valve 26 is positioned. The output signal of the running operation unit 60 is fed to a change-over valve squeezing amount setter 100 which sets an instruction to the change-over valve 42 in response to an output signal that varies depending upon the operation quantity of the running operation means 60. That is, the squeezing amount (opening degree) of the change-over valve 42 is calculated in response to an output signal that varies depending upon the operation quantity of the running operation means 60 to set an instruction value. The calculation is made such that the squeezing amount of the change-over valve 42 increases (opening degree of the by-pass line decreases) with an increase in the operation quantity of the running operation means 60. The output signal of the change-over valve squeezing amount setter 100 is converted into a voltage through the D/A converter, converted into an electric current value through the proportional valve amplifier, and is fed to the solenoid of the change-over valve 42 which is made up of an electromagnetic proportional valve. When the running operation means 61 is operated, the control valve 28 is operated in compliance with the step N-6 mentioned above, and an instruction is set, depending upon the operation quantity of the running operation means 61, to the change-over valve 48 disposed on the by-pass line of the side (left side in FIG. 2) opposite to the by-pass line on which the control valve 28 is disposed. The output signal of the running operation means 61 is fed to a change-over valve squeezing amount setter 102 where the arithmetic operation is carried out in the same manner as described above, and the change-over valve 48 is operated based upon an output signal thereof in the same manner as the above-mentioned change-over valve 42.

At a step N-8, it is judged whether any one of the operation means 62 to 65 on the side of the turning body, which is other than the operation means of the running apparatuses is operated or not. The program proceeds to a step N-9 when any one of the operation means 62 to 65 is operated, while it returns back to the step N-1 when none of them is operated. At the step N-9, it is judged whether the change-over valve 54 is turned on or not. The program proceeds to a step N-11 when the change-over valve 54 is turned on, while it proceeds to a step N-10 when the change-over valve 54 is not turned on. At the step N-10, the processing is executed in the same manner as in the step N-4. That is, the change-over valve 54 is turned on, whereby the running drive hydraulic circuit and the hydraulic circuit for driving the apparatus on the side of the turning body are completely isolated from each other. After the processing is executed at the step N-4, the program proceeds to the step N-11.

At the step N-11, an instruction is set to the hydraulic pump 20 depending upon the operation quantities (operation signals) of the operation means 62 to 65 of the apparatus on the side of the turning body in order to actuate the actuators 14 to 19 of the apparatus on the side of the turning body. The operation means 62 to 65 are operated individually or in combination. Referring to FIG. 5, the output signal of the boom operation means 62 is fed to a flow-rate setter **80*a* or 80*b* via a change-over switch 68. The change-over switches 68 shown in FIG. 5 are changed for their states by the operation mode selection switch 56 that is manually operated in the same manner as shown in FIG. 4. When the lifting operation mode is selected by the operation mode selection switch 56, the change-over switches 68 are changed over to the sides of dotted lines shown in FIG. 5. As a result, the output signal of the boom operation means 62 is fed to the flow-rate setter 80*a*** via the change-over switch.

The flow-rate setter **80*a* sets an instruction to the hydraulic pump 20 in response to an output signal that changes depending upon the operation quantity of the boom operation means 62. That is, in response to an output signal that varies depending upon the operation quantity of the boom operation means 62, the flow-rate setter 80*a* sets an instruction that corresponds to the blow-out rate which the boom cylinder 16 requires from the hydraulic pump 20. Similarly, output signals of the arm operation means 63, bucket operation means 64 and turning operation means 65 are fed to the flow-rate setters 82*a*, 84*a*, 86*a* via the change-over switches 68. In response to the output signals that vary depending upon the operation quantities of the operation means 62 to 65, the flow-rate setters 82*a*, 84*a* and 86*a* set instructions to the hydraulic pump 20, as similarly above. The outputs from the flow-rate setters 80*a* to 86*a* are summed up through an adder 88, and are subjected to the upper- and lower-limit processing through an upper-and-lower limit setter 89 thereby to set a pump instruction value. The output of the upper-and-lower limit setter 89 is fed to the swash plate controller 20*a* of the hydraulic pump 20. The swash plate controller 20*a* processes the output signal of the upper-and-lower limit setter 89 in the same manner as the aforementioned swash plate controller 22*a* thereby to set a blow-out rate of the hydraulic pump 20**.

Even in this case, a completely isolated hydraulic circuit is maintained to be formed by the change-over valve 54 that is turned on and, hence, the pressurized fluid is all fed from the hydraulic pump 20 only to the boom cylinder 16, arm cylinder 18, bucket cylinder 19 and turning hydraulic motor 14 which are the actuators in the apparatus on the side of the turning body. That is, the four actuators are driven by the hydraulic pump 20 only and, hence, the flow-rate setters **80*a*, 82*a*, 84*a* and 86*a* set instructions to the hydraulic pump 20, so that the blow-out rate of the hydraulic pump 20 that varies depending upon the operation quantities of the operation means 62 to 65 in the lifting operation mode will become smaller than one half the blow-out rate of during the ordinary operation mode as represented by a solid line in FIG. 9. Due to such a control operation, the operation speeds of the actuators 16 to 19 during the lifting operation become slower than those of during the ordinary operation. Accordingly, interference to the load (phenomenon in which the pressurized fluid fed from the hydraulic pump 20 to one actuator flows partly to other actuators as the other actuators are actuated while the one actuator is being actuated) is suppressed among the actuators 16 to 19**, and the operation is stably executed contributing to enhancing fine operation performance.

Figure 6:
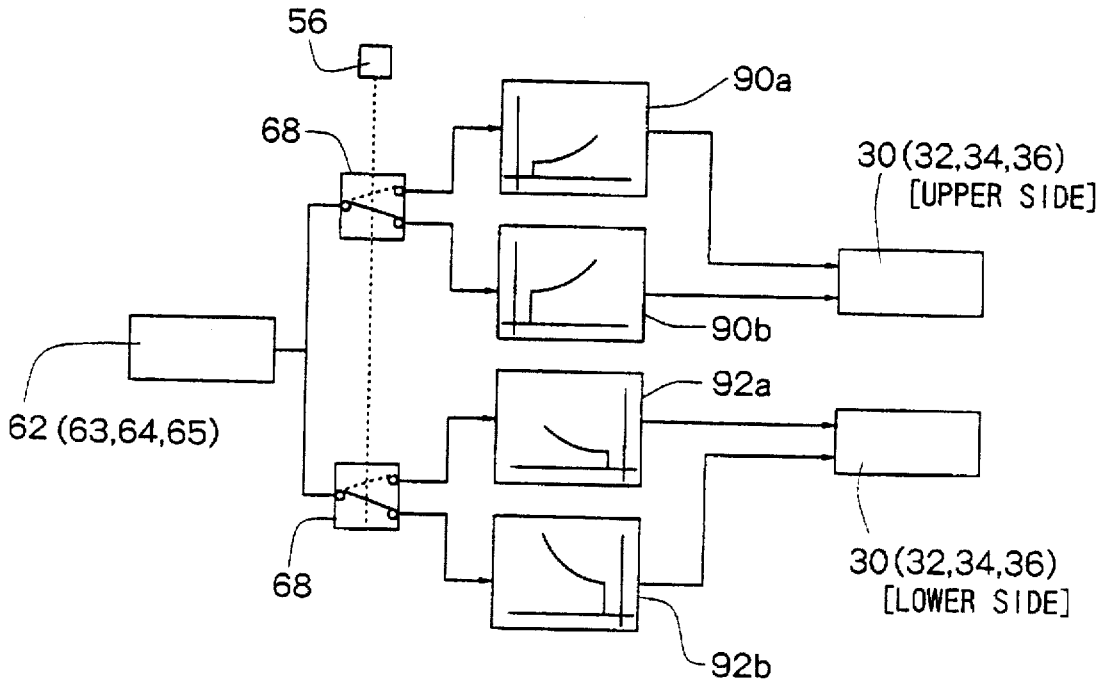
FIG. 6 is a flow chart of signals illustrating the processing of signals of a control valve opening degree setting means related to the operation of the apparatus on the side of the turning body in the apparatus for controlling the lifting operation of FIG. 1.

At a step N-12, in order to control the supply of the pressurized fluids to the turning hydraulic motor 14, boom cylinder 16, arm cylinder 18 and bucket cylinder 19 which are actuators of the apparatus on the side of the turning body, instructions are set to the corresponding control valves 30 to 36 depending upon the operation quantities of the corresponding operation means 62 to 65. The operation means 62 to 65 are operated individually or in combination. Described below with reference to FIG. 6 is a case where the boom operation means 62 is operated in one direction. The change-over switches 68 shown in FIG. 6 are changed over for their states by the operation mode selection switch 56 that is manually operated in the same manner as shown in FIGS. 4 and 5. When the lifting operation mode is selected by the operation mode selection switch 56, the change-over switches 68 are changed over to the sides of dotted lines in FIG. 6. As a result, the output signal of the boom operation means 62 is fed to a control valve opening degree setter 90*a* via the change-over switch 68. In response to an output signal that varies depending upon the operation quantity of the boom operation means 62, the control valve opening degree setter 90*a* sets an instruction to the corresponding boom control valve 32. That is, in response to the output signal that varies depending upon the operation quantity of the boom operation means 62, the opening degree of the boom control valve 32 is calculated and an instruction value is set in order to obtain a flow rate for feeding to the boom cylinder 16. The output signal of the control valve opening degree setter 90*a* is converted into a voltage through a D/A converter, converted into an electric current through a proportional valve amplifier, and is fed to one solenoid (e.g., upper side in FIG. 2) of the boom control valve 32 made up of an electromagnetic proportional valve in the operation direction of the boom operation means 62.

When the boom operation means 62 is operated in the other direction, the output signal of the boom operation means 62 is fed to a control valve opening degree setter 92*a* via the change-over switch 68. The control valve opening degree setter 92*a* executes the same arithmetic processing as in the control valve opening degree setter 90*a*, and its output signal is fed to the other solenoid (lower side in FIG. 2) of the boom control valve 32. In the lifting operation, the control valve opening degree setter 90*a* sets an instruction to the boom control valve 32 based upon the operation signal of the boom operation means 62, so that the flow rate of the boom control valve 32 that varies depending upon the operation quantity of the boom operation means 62 in the lifting operation mode will become smaller than one half the flow rate of during the ordinary operation mode as represented by a solid line in FIG. 9. Signal processings based upon the operations of other operation means 63, 64 and 65 are carried out substantially in the same manner as described above. Due to such a control operation, the operation speeds of the actuators 16 to 19 during the lifting operation become slower than those of during the ordinary operation. Accordingly, interference to the load is suppressed among the actuators 16 to 19, and the operation is stably executed contributing to enhancing fine operation performance.

When the ordinary operation mode is selected at the step N-1 as described above, the program proceeds to a step N-13 where the ordinary operation is executed. The content for controlling the ordinary operation does not pertain to the object of the present invention and is, hence, described only briefly. In the ordinary operation, the control operation is basically carried out in the same manner as described above in connection with the prior art. Depending upon the mode of operation, therefore, the hydraulic circuit is changed over to a shunt hydraulic circuit or to an isolated hydraulic circuit. When the running operation means 60 is operated in a state where the isolated hydraulic circuit is formed, the output signal is fed to the flow-rate setter 70*b* via the change-over switch 68 as shown in FIG. 4. When the running operation means 61 is operated, furthermore, the output signal is fed to the flow-rate setter 72*b* via the change-over switch 68 (the change-over switch 68 is changed over to the side of a solid line in FIG. 4 by the operation mode selection switch 56). An instruction is set to the hydraulic pump 22 so that the blow-out rate of the hydraulic pump 22 that varies in response to the operation quantities of the running operation means 60 and 61 during the ordinary operation mode will comply with the characteristics shown by a dotted line in FIG. 8. The output signals of the flow-rate setters 70*b* and 72*b* are processed in the same manner as described above, and the blow-out rate of the hydraulic pump 22 is set.

When the operation units 62, 63, 64 and 65 other than those of the running apparatuses are operated in a state where the isolated hydraulic circuit is formed, the output signals are fed to the flow-rate setters 80*b*, 82*b*, 84*b* and 86*b* via the change-over switches 68 that have been in advance changed over to the sides of solid lines, as shown in FIG. 5. The flow-rate setters 80*b* to 86*b* set instructions to the hydraulic pump 20, so that the blow-out rate of the hydraulic pump 20 that varies depending upon the operation quantities of the operation means 62 to 65 in the ordinary operation mode will comply with the characteristics shown by a dotted line in FIG. 9. The output signals of the flow-rate setters 80*b* to 86*b* are processed in the same manner as described earlier, and the blow-out rate of the hydraulic pump 20 is set. When the operation means 62, 63, 64 and 65 are operated, instructions are set to the corresponding control valves 30, 32, 34 and 36 depending upon their operation quantities. Described below with reference to FIG. 6 is the case where the boom operation means 62 is operated in one direction. The output signal is fed to the control valve opening degree setter 90*b* via the change-over switch 68 that has been in advance changed over to the side of the solid line. In the ordinary operation, the control valve opening degree setter 90*b* sets an instruction to the boom control valve 32 based upon the operation signal of the boom operation means 62, so that the flow rate of the boom control valve 32 that varies depending upon the operation quantity of the boom operation means 62 during the ordinary operation mode will comply with the characteristics shown by the dotted line in FIG. 9. The signals due to the operations of other operation means 63, 64 and 65 are processed substantially in the same manner as described above. After the ordinary operation is executed at the step N-13, the program returns to the step N-1.

Though the present invention was described above in detail by way of an embodiment, it should be noted that the invention is in no way limited to the above-mentioned embodiment only but can be changed or modified in a variety of other ways without departing from the scope of the invention. For instances instructions can be set to the corresponding control valves based upon the operation signals of the operation means. In this case (hanging operation mode) according to the embodiment, however, the instruction values to the control valves other than those of the running apparatuses are suppressed to become smaller than one half those of the ordinary operation mode (see solid line in FIG. 9). The flow rate that is fed to the running motor in the isolated hydraulic circuit is nearly one half the flow rate in the shunt hydraulic circuit. Therefore, since the running speed has been dropped at a moment when the shunt hydraulic circuit is changed over to the isolated hydraulic circuit, no operation is carried out in this embodiment to squeeze the opening degree of the running control valve. As required, however, the instruction value to the running control valve may be suppressed to become smaller than one half that of the ordinary operation mode based on the operation signal of the running operation means like that of other control valves.

In the apparatus for controlling the lifting operation constituted according to the present invention, the running drive hydraulic circuit and the hydraulic circuit for driving the apparatus on the side of the turning body are automatically isolated from each other during the lifting operation. Therefore, interference to the load is greatly decreased compared with that of the prior art between the actuators of the running apparatuses and the actuators of the apparatus on the side of the turning body, enabling the operation performance and workability during the lifting operation to be enhanced. Being provided with a hydraulic circuit isolating means for completely isolating the above-mentioned circuits from each other, interference to the load is completely suppressed, and the above operation performance and workability are further enhanced. During the lifting operation, operation speeds of the actuators that vary depending upon the operation quantities of the operation means are rendered to become slower than those of during the ordinary operation, contributing to enhancing operation performance and workability in the lifting operation. With operation speeds of the actuators of the running apparatuses and of the apparatus of the side of the turning body being lowered, furthermore, interference to the load occurs little among the actuators, and operation performance during the lifting operation is improved.

What we claim is:

1. An apparatus for controlling the lifting operation in a construction machine comprising a lower running body including a pair of running apparatuses, an upper turning body provided on said lower running body to freely turn thereon, an operation machine swingably mounted on said upper turning body, actuators for actuating said running apparatuses, said upper turning body and said operation machine, and a pair of variable-capacity hydraulic pumps for feeding pressurized fluid to said actuators, wherein it further comprises:

an operation mode selection means which is selectively set to an ordinary operation mode or to a lifting operation model; and a hydraulic circuit isolating means for isolating the hydraulic circuit into a running drive hydraulic circuit which feeds the pressurized fluid of one of said variable-capacity hydraulic pumps to the actuators of said running apparatuses when said operation mode selection means is set to said lifting operation mode and a hydraulic circuit for driving the apparatus on the side of the turning body, which feeds the pressurized fluid of the other variable-capacity hydraulic pump to the actuators other than those of said running apparatuses.

2. An apparatus for controlling the lifting operation according to claim 1, wherein it further comprises operation means provided in relation to said running apparatuses, said upper turning body and said operation machine to actuate them, and said hydraulic circuit isolating means includes a circuit communication flow passage for communicating said running drive hydraulic circuit and said hydraulic circuit for driving the apparatus on the side of the turning body and a hydraulic circuit separating means for completely isolating said circuits by shutting off said circuit communication flow passage when any one of said operation means is operated.

3. An apparatus for controlling the lifting operation according to claim 2, wherein said hydraulic circuit isolating means is constituted by a running straight compensation valve that is changed over when said operation mode selection means is set to said lifting operation mode, said running straight compensation valve includes said hydraulic circuit communication flow passage and said hydraulic circuit separating means, and said hydraulic circuit separating means is made up of a change-over valve which opens and closes said hydraulic circuit communication flow passage.

4. An apparatus for controlling the lifting operation according to claim 1, further comprising control valves provided in relation to said running apparatuses, said upper turning body and said operation machine to control the pressurized fluid supplied to said actuators, operation means provided in relation to said control valves to control their operations, and an operation speed setting means which sets the operation speeds of said actuators in response to the operation quantities of said operation means during the lifting operation mode to be slower than those of during the ordinary operation mode.

5. An apparatus for controlling the lifting operation according to claim 4, wherein said operation speed setting means comprises one of pump flow rate setting means for setting the blow-out rate of one of said variable-capacity hydraulic pumps in accordance with the operation quantities of said operation means of said running apparatuses, another pump flow rate setting means for setting the blow-out rate of the other variable-capacity hydraulic pump in accordance with the operation quantities of said operation means of the apparatus other than said running apparatuses, and a control valve opening degree setting means for setting the opening degrees of said control valves depending upon the operation quantities of said operation means of said running apparatuses, said upper turning body and said operation machines and wherein said one pump flow rate setting means and said another pump flow rate setting means work to set the blow-out rates that vary depending upon the operation quantities of said operation means during the lifting operation mode to be smaller than those of during the ordinary operation mode, and said control valve opening degree setting means sets the opening degrees of said control valves that vary depending upon the operation quantities of said operation means of said upper turning body and said operation machine during the lifting operation mode to be smaller than those of during the ordinary operation mode.

6. An apparatus for controlling the lifting operation in a construction machine comprising a lower running body including a pair of running apparatuses an upper turning body provided on said lower running body to turn thereon, an operation machine swingably mounted on said upper turning body, actuators for actuating said running apparatuses, said upper turning body and said operation machine, a pair of variable-capacity hydraulic pumps for feeding pressurized fluid to said actuators, control valves provided in relation to said running apparatuses, said upper turning body and said operation machine to control the supply of pressurized fluids to said actuators, and an operation means provided in relation to said control valves to control their operations, wherein it further comprises:

an operation mode selection means which is selectively set to an ordinary operation mode or to a lifting operation mode; and an operation speed setting means which, when said operation mode selection means is set to said lifting operation mode, sets the operation speeds of said actuators that vary depending upon the operation quantities of said operation means to be smaller than those of when said ordinary operation mode is set.

7. An apparatus for controlling the lifting operation according to claim 2, further comprising control valves provided in relation to said running apparatuses, said upper turning body and said operation machine to control the pressurized fluid supplied to said actuators, operation means provided in relation to said control valves to control their operations, and an operation quantities of said operation means during the lifting operation mode to be slower than those of during the ordinary operation mode.

8. An apparatus for controlling the lifting operation according to claim 3, further comprising control valves provided in relation to said running apparatuses, said upper turning body and said operation machine to control the pressurized fluid supplied to said actuators, operation means provided in relation to said control valves to control their operations, and an operation speed setting means which sets the operation speeds of said actuators in response to the operation quantities of said operation means during the lifting operation mode to be slower than those of during the ordinary operation mode.

9. An apparatus for controlling the lifting operation according to claim 7, wherein said operation speed setting means comprises one of pump flow rate setting means for setting the blow-out rate of one of said variable-capacity hydraulic pumps in accordance with the operation quantities of said operation means of said running apparatuses, another pump flow rate setting means for setting the blow-out rate of the other variable-capacity hydraulic pump in accordance with the operation quantities of said operation means of the apparatus other than said running apparatuses, and a control valve opening degree setting means for setting the opening degrees of said control valves depending upon the operation quantities of said operation means of said running apparatuses, said upper turning body and said operation machine, and wherein said one pump flow rate setting means and said another pump flow rate setting means work to set the blow-out rates that vary depending upon the operation quantities of said operation means during the lifting operation mode to be smaller than those of during the ordinary operation mode, and said control valve opening degree setting means sets the opening degrees of said control valves that vary depending upon the operation quantities of said operation means of said upper turning body and said operation machine during the lifting operation mode to be smaller than those of during the ordinary operation mode.

10. An apparatus for controlling the lifting operation according to claim 8, wherein said operation speed setting means comprises one of pump flow rate setting means for setting the blow-out rate of one of said variable-capacity hydraulic pumps in accordance with the operation quantities of said operation means of said running apparatuses, another pump flow rate setting means for setting the blow-out rate of the other variable-capacity hydraulic pump in accordance with the operation quantities of said operation means of the apparatus other than said running apparatuses, and a control valve opening degree setting means for setting the opening degrees of said control valves depending upon the operation quantities of said operation means of said running apparatuses, said upper turning body and said operation machine, and wherein said one pump flow rate setting means and said another pump flow rate setting means work to set the blow-out rates that vary depending upon the operation quantities of said operation means during the lifting operation mode to be smaller than those of during the ordinary operation mode, and said control valve opening degree setting means sets the opening degrees of said control valves that vary depending upon the operation quantities of said operation means of said upper turning body and said operation machine during the lifting operation mode to be smaller than those of during the ordinary operation mode.

* * * * *